US005829079A

United States Patent [19]

Castro

[11] Patent Number: 5,829,079

[45] Date of Patent: Nov. 3, 1998

[54] PORTABLE SAND FILLED PILLOW

[76] Inventor: Timothy J. Castro, 350 Carrera Cir., Aptos, Calif. 95003

[21] Appl. No.: 987,806

[22] Filed: Dec. 10, 1997

[51] Int. Cl.[6] ..... A47G 9/00

[52] U.S. Cl. ..... 5/636; 5/644

[58] Field of Search ..... 5/636, 637, 644, 5/645, 641, 922, 490, 491

[56] References Cited

U.S. PATENT DOCUMENTS

| | | | |
|---|---|---|---|
| 243,869 | 7/1881 | Doremus | 5/491 |
| 1,542,561 | 6/1925 | Laskin et al. | 5/490 |
| 3,234,569 | 2/1966 | Stewart | 5/643 |
| 3,378,860 | 4/1968 | Frazier | 5/491 |
| 3,802,704 | 4/1974 | Genua | 5/491 |
| 3,900,910 | 8/1975 | Nakata | 5/636 |
| 4,193,152 | 3/1980 | Seibold, Jr. | 5/636 |
| 5,148,564 | 9/1992 | Reder | 5/636 |
| 5,173,979 | 12/1992 | Nennhaus | 5/645 |
| 5,522,105 | 6/1996 | Fujiwara et al. | 5/636 |
| 5,706,535 | 1/1998 | Takashima | 5/641 |

*Primary Examiner*—Alex Grosz
*Attorney, Agent, or Firm*—Jeffrey A. Hall

[57] ABSTRACT

A portable sand pillow for resting or supporting a body part of a user, comprising, a support member with a top side and a bottom side, a front end and a rear end. The support member having an inner cavity for holding and securing sand in a desired configuration therein. An aperture with matching hook and loop fastening elements secured around the perimeter allows for opening and closing the support member and sealing the inner cavity. The aperture being adapted to allow the inner cavity to be filled with sand and to retain the sand within the inner cavity. An upper support element is secured to the upper surface of the support member for supporting and cushioning a body part of the user, and a pair of end elements are secured to the support element, one of the pair of end elements being secured to the front end of the support element and the other being secured to the rear end of the support element.

1 Claim, 1 Drawing Sheet

PORTABLE SAND FILLED PILLOW

BACKGROUND OF THE INVENTION

1. Field of Invention

This invention relates to pillows, and more particularly to portable pillows which are filled with particulates such as sand for providing support and comfort at beaches, lakes, rivers and the like.

2. Description of the Related Art

Various pillows and supports have been proposed and implemented for cushioning and supporting a part of a human body. Typically pillows are comprised of a casing or sack like enclosure which is filled with a cushioning fill, such as down or foam. The present invention is an improved pillow or support rest for use in outdoor settings which provides a cushioning support or rest for the user.

The pillow of the present invention differs from all prior pillows known to applicant in that it's design and configuration allow the pillow to be easily filled with sand or other particulate allowing for a unique pillow or rest which may be filled or emptied of the sand or particulate with ease. This allows the pillow to be easily stored, packed and transported when the sand or particulates are removed from the pillow, or to be formed in a desired shape and size by simply filling the pillow with sand or other particulate. The pillow of the present invention is accordingly extremely useful for outdoor outings such as at ocean beaches, rivers, lakes, and the like.

Accordingly, it is the primary object of this invention to provide a portable sand pillow which allows for the easy storage, packing or transport of the pillow which may be filled or emptied as desired with sand or other particulate. The pillow of the present invention is efficient, effective, convenient, and safe to use. The sand pillow of the present invention is also easy to use and fill with sand or other particulate, quickly deployable, and quickly and easily stored when not in use.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims.

SUMMARY OF THE INVENTION

To achieve the foregoing objects, and in accordance with the purpose of the invention as embodied and broadly described herein, a portable sand pillow for resting or supporting a body part of a user is provided, comprising in one embodiment, a support member with a top side and a bottom side, a front end and a rear end. The support member has an inner cavity for holding and securing sand in a desired configuration therein. An aperture with matching hook and loop fastening elements secured around the perimeter of the aperture allows for opening and closing the support member and sealing the inner cavity. The aperture is adapted to allow the inner cavity to be filled with sand or other particulates and to retain the sand or other particulates within the inner cavity. An upper support element is secured to the upper surface of the support member for supporting and cushioning a body part of the user, and a pair of end elements are secured to the support element, one of the pair of end elements being secured to the front end of the support element and the other being secured to the rear end of the support element.

The pillow of the present invention may be provided in a variety of shapes and sizes to accommodate different uses and individual choices and styles. The support member is preferably composed of nylon covered neoprene or other durable resilient material. The upper support element is preferably composed of a layer of foam sandwiched between two neoprene layers.

The present invention is configured to permit filling or emptying of the pillow while providing a very comfortable and attractive support rest. The pillow of the present invention is preferably cylindrically configured, however, other geometric shapes may be used if desired.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Reference will now be made in detail to the present preferred embodiments of the invention as illustrated in the accompanying drawings.

In accordance with the present invention, there is provided in a preferred embodiment of the invention, a portable sand pillow for resting or supporting a body part of a user, comprising, a support member with a top side and a bottom side, a front end and a rear end. The support member has an inner cavity for holding and securing sand or other particulates in a desired configuration therein. An aperture with matching hook and loop fastening elements secured around the perimeter is positioned on a bottom surface of the support member and allows for opening and closing the support member and sealing the inner cavity. The aperture is adapted to allow the inner cavity to be filled with sand or other particulates and to retain the sand or particulates within the inner cavity. An upper support element is secured to the upper surface of the support member for supporting and cushioning a body part of the user, and a pair of end elements are secured to the support element, one of the pair of end elements being secured to the front end of the support element and the other being secured to the rear end of the support element.

In accordance with the present invention, there is also provided an improved pillow of the type in which a casing element secures a fill material in a desired configuration, wherein the improvement comprises means for securing a plurality of particles within the casing element, and; means for opening and closing the casing element allowing the plurality of particles to be filled within the casing element or removed from the casing element. A top support and cushioning element is secured to the support member for supporting and cushioning a body part of the user.

Figure 1:
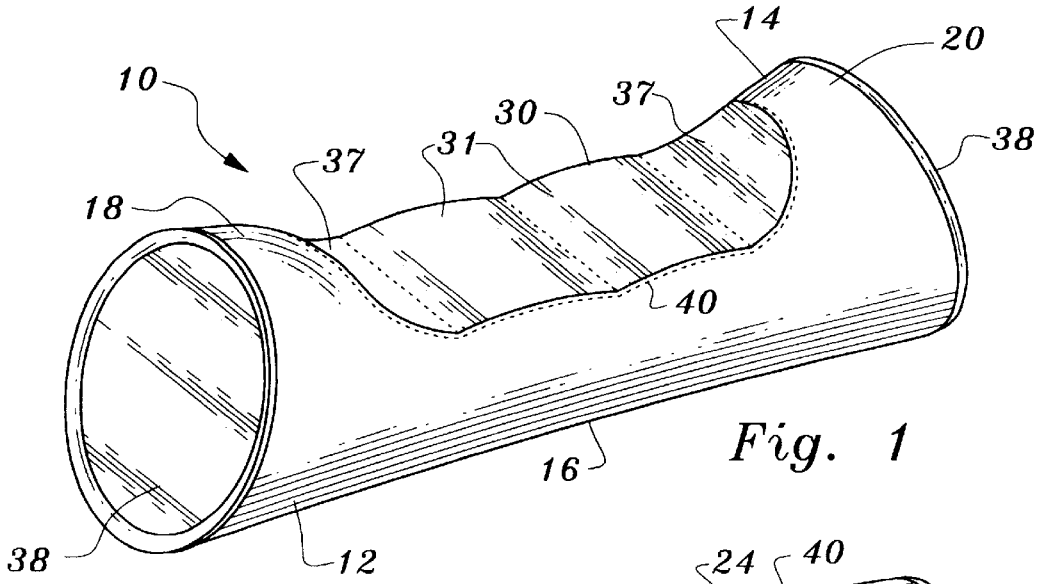
FIG. 1 is a front perspective view of a sand pillow, according to the invention.

In FIG. 1, sand pillow 10 is shown according to a preferred embodiment of the invention. Sand pillow 10 is shown with support member 12 having a top side 14 and a bottom side 16, a front end 18, and a rear end 20. The support member 12 has an inner cavity 22 for holding and securing sand 24 or other particulate in a desired configuration. In FIG. 1, sand pillow 10 is shown with support member 12 in a cylindrical configuration, however, in alternative embodiments other shapes may also be used such as round, oval, square, rectangular, triangular, or the like. Support member 12 is preferably composed of neoprene 11 with a nylon cover layer 23, however, other durable resilient materials may also be used such as rubber or plastic.

Support member 12 is provided with means for opening and closing inner cavity 22, which in the preferred embodiment is aperture 26 with perimeter 27 having matching strips or patches of hook and loop fastening material sewn with stitches 40 or otherwise secured thereto. Aperture 26 provides a means to fill inner cavity 22 with sand or other particulates or to empty inner cavity 22 of the sand or particulates when pillow 10 is to be packed, stored or transported.

Figure 2:
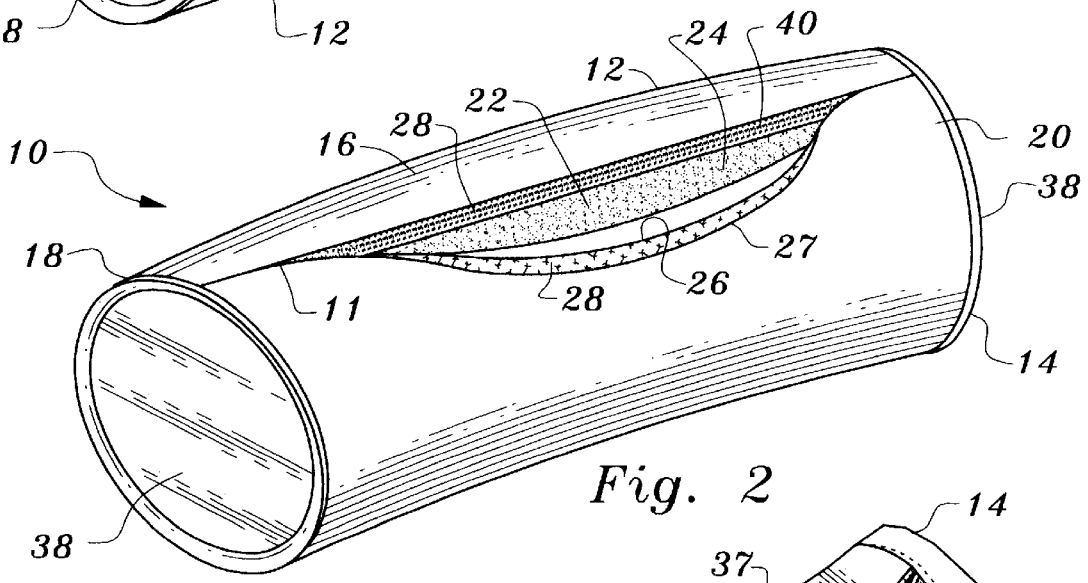
FIG. 2 is a bottom perspective view of a sand pillow, according to the invention.

In FIG. 2, aperture 26 is shown opened to receive sand or other particulates to fill cavity 22 with hook and loop fastening elements 28 secured around perimeter 27. Inner cavity is preferably filled with sand 24 which is readily available at ocean or lake beaches, river banks, and other outdoor locations. However, if desired inner cavity 22 may be filled with other particulates such as pieces of foam, or paper, cloth, clothing, or other fill material if desired.

Figure 3:
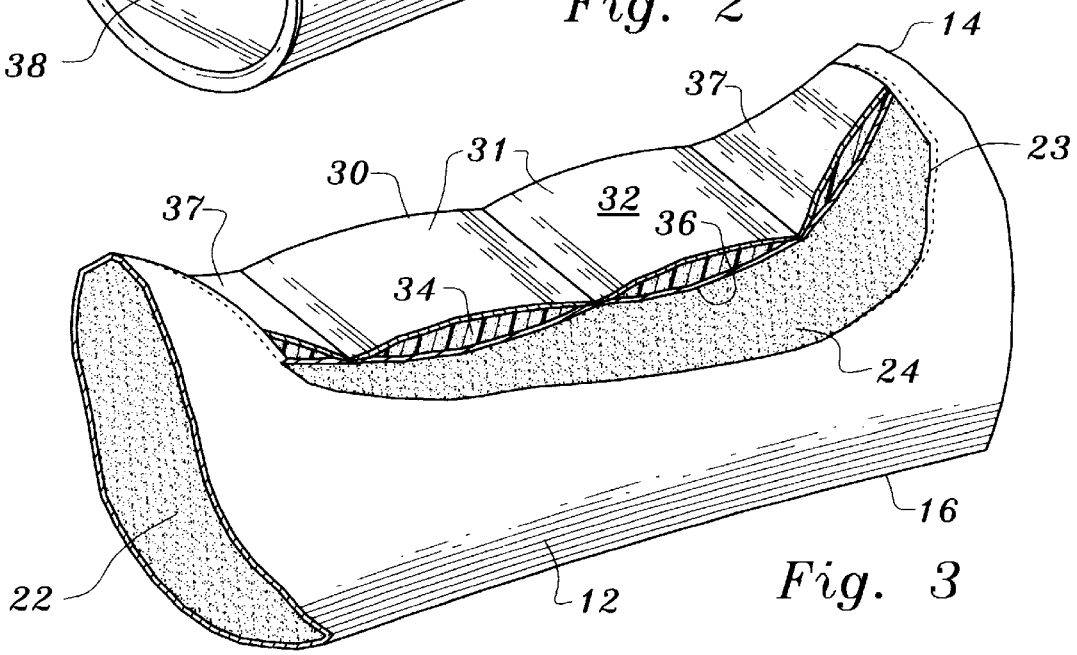
FIG. 3, is a cut-away view through the upper support element of such sand pillow, according to the invention.

Best seen in FIG. 1 and 3, is upper support element 30. In FIG. 3. upper support element 30 is shown constructed with a top layer 32 of neoprene, an inner foam layer 34, and a bottom layer 36 composed of neoprene. Preferably upper support layer 30 is oblong configured as shown with sloped ends 37 and substantially flattened area 31 and may be sewn with stitches 40 or otherwise secured to support member 12, for example, by adhesives. However, other configurations of upper support element 30 may be used such as circular, square, rectangular, oval, and the like. Also seen in FIGS. 2 and 3 is nylon layer 23 covering neoprene layer 11 of support member 12.

As seen in FIGS. 1–3, pillow 10 is preferably configured with a pair of end elements 38, one secured to front end 18 of support member 12 and the other secured to rear end 20 of support member 12 by stitches, adhesives, or other fastening means well known in the art. End elements 38 are preferably provided in a circular configuration and a nylon/lycra piping or tape covers the seams joining end elements 38 to support member 12 and may be provided with or without a surrounding flange. However, in other embodiments end elements 38 may be provided in other configurations such as triangular, square, rectangular, oval and the like.

In operation and use sand pillow 10 is very convenient, easy, reliable, and effective to use for the cushioning and support of a body part. Pillow 10 may be used either indoors or outdoors and is especially configured for use in environments such as lake and ocean beaches, rivers, and the like. It is easily filled with sand or other particulates for use or emptied of sand or other particles when it is to be packed, stored or transported.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A portable sand pillow for resting or supporting a body part of a user, comprising:

a support member composed of neoprene, said support member having a top side and a bottom side, a front end and a rear end; said support member having an inner cavity for holding and securing sand in a desired configuration therein;

means for opening and closing said support member and sealing said inner cavity; said means for opening and closing said support member and sealing said inner cavity being adapted to allow said inner cavity to be filled with sand and to retain the sand within the inner cavity;

an upper support element being secured to said support member for supporting and cushioning a body part of said user, said upper support element comprises a layer of foam material sandwiched between two neoprene layers; and a pair of end elements secured to said support member, one of said pair of end elements being secured to said front end of said support member and one of said pair of end elements being secured to said rear end of said support member.

* * * * *